United States Patent [19]

Matsushima et al.

[11] Patent Number: 4,780,596

[45] Date of Patent: Oct. 25, 1988

[54] HOT-AIR CIRCULATION COOKING OVEN

[75] Inventors: Kazufumi Matsushima, Nishikasugai; Yoshinari Arabori; Kazuo Ichikawa, both of Nagoya, all of Japan

[73] Assignee: Kabushiki Kaisha Toshiba, Kawasaki, Japan

[21] Appl. No.: 26,997

[22] Filed: Mar. 17, 1987

[30] Foreign Application Priority Data

May 15, 1986 [JP] Japan ..... 61-111112
May 21, 1986 [JP] Japan ..... 61-76553
May 26, 1986 [JP] Japan ..... 61-79456

[51] Int. Cl.[4] ..... F27D 7/04; A21B 1/26
[52] U.S. Cl. ..... 219/400; 126/21 A
[58] Field of Search ..... 219/400; 126/21 A, 21 R; 34/195, 197, 210, 215, 218, 219, 224, 225, 231, 232, 233

[56] References Cited

U.S. PATENT DOCUMENTS 2,906,620 9/1959 Jung ..... 219/400
3,324,844 6/1967 Huffman ..... 34/225
4,068,572 1/1978 Vogt ..... 219/400
4,415,799 11/1983 Tanaka ..... 126/21 A
4,462,383 7/1984 Henke ..... 219/400
4,627,409 12/1986 Kagomoto ..... 126/21 A

FOREIGN PATENT DOCUMENTS 53-136572 11/1978 Japan ..... 219/400
58-35927 8/1983 Japan ..... 219/400
82/01662 5/1982 PCT Int'l Appl. ..... 219/400
2054833 2/1981 United Kingdom ..... 219/400

*Primary Examiner*—E. A. Goldberg
*Assistant Examiner*—Teresa J. Walberg
*Attorney, Agent, or Firm*—Cushman, Darby & Cushman

[57] ABSTRACT

A cooking oven includes a box-like casing defining a heating chamber wherein food in placed. A rear plate of the casing has a recess projecting outward, a number of suction holes cut in the bottom of the recess, and a number of discharge holes cut in sections located above and below the recess. A cover is fixed to the outer surface of the rear plate to define a storing chamber. In the storing chamber are arranged a fan for drawing air in the heating chamber into the storing chamber and discharging the air into the heating chamber, and a heater for heating the sucked air. The cover has a first air-directing section for directing part of the hot air from the fan in a direction parallel to the top plate of the casing, and a second air-directing section for directing part of the hot air in a direction different from the direction of the hot air directed by the first air-directing section.

6 Claims, 3 Drawing Sheets

HOT-AIR CIRCULATION COOKING OVEN

BACKGROUND OF THE INVENTION

1. Field of the Art

This invention relates to a hot-air circulation cooking oven for cooking food within a heating chamber by circulating hot air within the chamber using a fan.

2. Background of the Related Art

Generally, a hot-air circulation cooking oven has an inner casing defining a heating chamber for storing a cooking tray at its center and a pan-like cover attached to the rear plate of the inner casing to define a fan chamber in which a hot air circulation fan and heater are provided. A number of suction holes are cut, such as punched holes, in the center portion of the rear plate. A number of upper discharge holes and of lower discharge holes are cut in the upper and lower portions of the rear plate, above and below the suction holes. The upper and lower discharge holes are formed in a bandlike array extending in the horizontal direction. The fan is arranged opposite to the suction holes and driven by a motor which is provided external to the cover. A heater is ring-like in configuration and provided around the fan.

When the fan and heater are operated, with two cooking trays set within the heating chamber, air within the heating chamber is sucked into the fan chamber through the suction holes opening between the cooking trays, and is heated by the heater and becomes hot. The hot air is blown into the heating chamber through the discharge holes provided between the top plate of the inner casing and the upper cooking tray, and between the bottom plate of the inner casing and the lower cooking tray. The hot air flows toward the neighborhood of a door situated in front of the heating chamber, and then is sucked again through the suction holes into the fan chamber. In this away, the hot air is circulated within the heating chamber to cook the food set within the heating chamber.

In the cooking oven thus manufactured, the hot air has to be circulated up to the region remote from the discharge holes, i.e., around the door in front of the heating chamber. The portion of the cover facing the discharge holes is inclined toward the heating chamber. Thus the hot air from the fan is directed by the inclined portion toward the heating chamber and sent toward the neighborhood of the door far distant from the discharge holes.

In the aforementioned structure, the hot air can be circulated from the discharge holes into a zone far from the discharge holes. However, more hot air is blown over food items on the cooking tray situated on the door side than the food items on the same cooking tray situated on the discharge hole side. This causes the food items set one behind another on the same tray to unevenly brown within the heating chamber.

Since the suction holes and discharge holes are provided adjacent to one another in the cooking oven, part of the hot air, which is discharged from the discharge holes, is short-circuited, thus causing it to blow from the suction holes directly into the fan chamber without being circulated through the heating chamber. As a result, this air cannot be effectively used to heat the food items and the heat is not adequately applied to the zone distant from the discharge holes, resulting in the uneven heating of the food items.

Because of this construction, it has been difficult in the conventional cooking oven to uniformly discharge hot air into the heating chamber to uniformly heat the food.

SUMMARY OF THE INVENTION

It is accordingly the object of this invention to provide a hot-air circulation cooking oven with a plurality of cooking trays, which can uniformly discharge hot air from discharge holes into a heating chamber, thereby reducing the uneven heating of food items.

In order to attain the above object, according to the present invention, a cooking oven includes the following elements:

A box-like casing has a top plate, bottom plate and a plurality of side plates and defining a heating chamber in which food items are placed. One of the side plates has an outwardly extending recess, a number of suction holes are formed at the bottom of the recess and a number of discharge holes are formed in sections located above and below the recess.

A plurality of cooking trays can be placed in the heating chamber, substantially parallel to the top plate.

A cover is fixed to the outer surface of the side plate with the suction discharge holes with that side plate defines a storing chamber communicating wit the suction holes and discharge holes.

A fan is arranged in the storing chamber to face the suction holes and draws the air within the heating chamber into the storing chamber through the suction holes and discharges the air into the heating chamber through the discharge holes. A motor rotates the fan.

A heater provided within the storing chamber along the outer periphery of the fan heats the air which is sucked into the storing chamber.

Another embodiment of this invention will now be described:

A box-like casing having a top plate, bottom plate and plurality of side plates and defining a heating chamber in which food is placed is included in this embodiment. One of the side plates has a plurality of suction holes and plurality of discharge holes formed in sections. The discharge holes are spaced from the suction holes and extend substantially horizontally.

A cover is fixed to the outer surface of this side plate and with that side plate defines a storing chamber communicating with the suction holes and discharge hole.

A fan in the storing chamber faces the suction holes and draws air within the heating chamber into the storing chamber through the suction holes and discharges the air into the heating chamber through the discharge holes. A motor rotates the fan.

A heater arranged the storing chamber and located around the outer periphery of the fan heats the air drawn into the storing chamber.

The cover has a first air-directing section located opposite the discharge holes and inclined at a predetermined angle for directing the air flow formed by the fan in a direction substantially horizontal to the top plate. A second air-directing section, also located opposite to the discharge holes, is inclined at an angle different from that of the first air-direction section and directs part of the air flow in a direction different from that of the air flow directed by the first air-directing section.

BRIEF DESCRIPTION OF THE DRAWINGS

These and other advantages of the present invention may be appreciated from studying the following detailed description of the preferred embodiment together with the drawings in which:

FIGS. 1 to 5 show a cooking oven according to a first embodiment of the invention, in which FIG. 1 is a longitudinal sectional view of the oven;

FIG. 2 is a cross-sectional view, taken along line II—II in FIG. 1;

FIG. 3 is a front view showing a cover with a fan and heater;

FIG. 4 is an enlarged sectional view showing a portion of the oven cover near the discharge holes; and FIG. 5 is an exploded, perspective view showing a fitting arrangement of the cover;

FIGS. 6 and 7 show a cooking oven according to a second embodiment of the invention, in which FIG. 6 is a front view showing a modification of FIG. 3; and FIG. 7 is a cross-sectional view showing a modification of FIG. 4; and FIGS. 8 and 9 show a cooking oven according to a third embodiment of the invention, in which FIG. 8 is a front view showing a modification of FIG. 3; and FIG. 9 is a cross-sectional view showing a modification of FIG. 4.

DETAILED DESCRIPTION OF THE PREFERRED EMBODIMENTS

Figure 1:
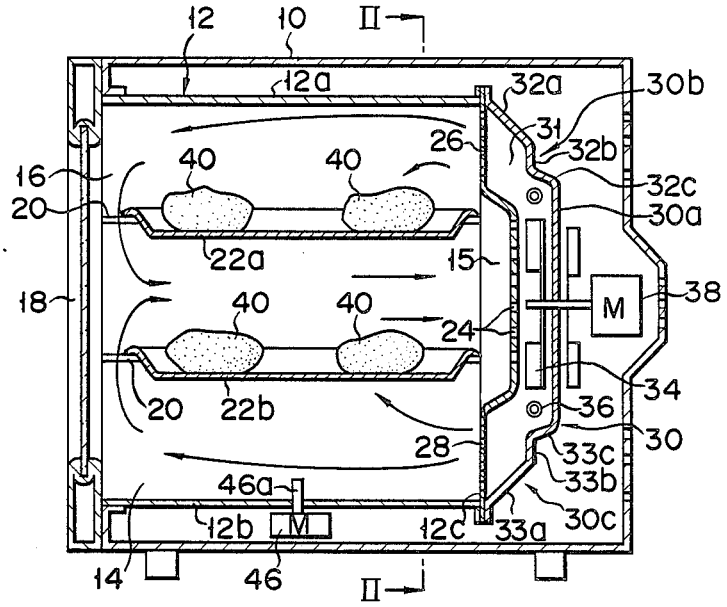
Figure 2:
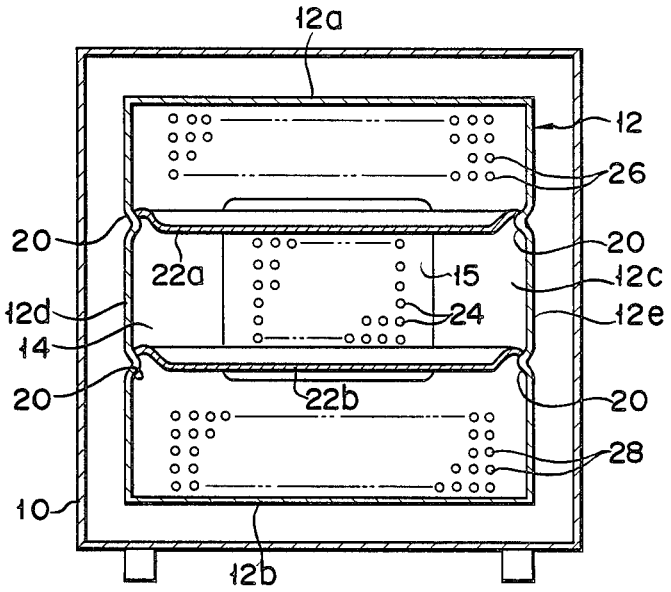
Figure 3:
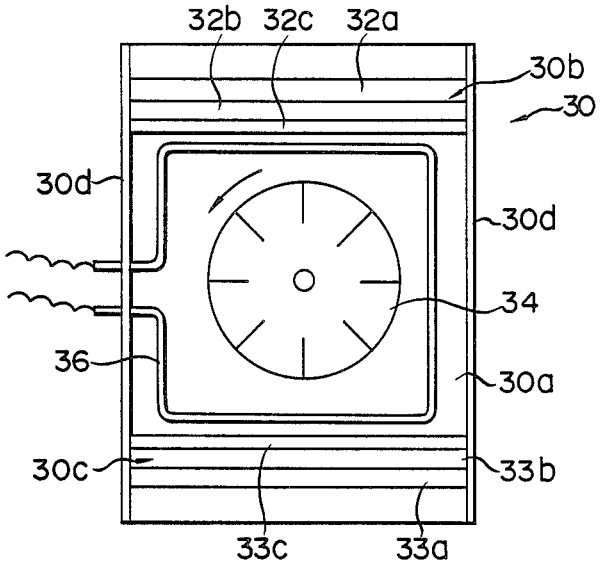

As shown in FIGS. 1 to 3, a hot-air circulation cooking oven includes outer casing 10 and inner casing 12 located within the outer casing and defining heating chamber 14. Casing 12 is box-like in configuration and has top plate 12*a*, bottom plate 12*b* and side plates 12*c* to 12*e* with access opening 16 located at the front side. Access to food within heating chamber 14 is gained by opening and closing door 18 which is attached to outer casing 10. A pair of support rails 20, 20 are formed on the inner surface of each of side plates 12*d* and 12*e*, and extend in the horizontal direction. Upper and lower cooking trays 22*a* and 22*b* are supported by corresponding support rails 20, 20 within heating chamber 14. Rails 20, 20 are so arranged that an equal internal is defined between top plate 12*a* of casing 12 and cooking tray 22*a*, between cooking trays 22*a* and 22*b*, and between cooking tray 22*b* and bottom plate 12*b*.

At the center portion of side plate 12*c*, i.e., the rear plate of casing 12, substantially rectangular recess 15 is formed by "drawing" such that it projects outwardly of the casing. At the bottom wall of recess 15, a plurality of punched holes are formed as suction holes 24 and distributed in a rectangular pattern. Suction holes 24 are formed at a location corresponding to the space between cooking trays 22*a* and 22*b*. A number of upper discharge holes 26 are formed in side plate 12*c* of casing 12 at a location situated above suction holes 24, or recess 15, whereas a number of lower discharge holes 28 are formed in side plate 12*c* of casing 12 at a location situated below recess 15. Upper exhaust holes 26 are arranged in a rectangular pattern across a substantially whole width of side plate 12*c* and situated at a location corresponding to the space defined between top wall 12*a* of casing 12 and upper cooking tray 22*a*. Lower discharge holes 28 are arranged in a rectangular pattern across a substantially whole width of side plate 12*c* and situated at a location corresponding to the space between lower cooking tray 22*b* and bottom plate 12*b* of casing 12.

Cover 30 is a rectangular pan-like in configuration and fixed to the outer surface of rear plate 12*c* to define storing chamber 31 therebetween. Storing chamber 31 communicates with heating chamber 14 through suction hole 24 and discharge hole 26, 28.

Figure 4:
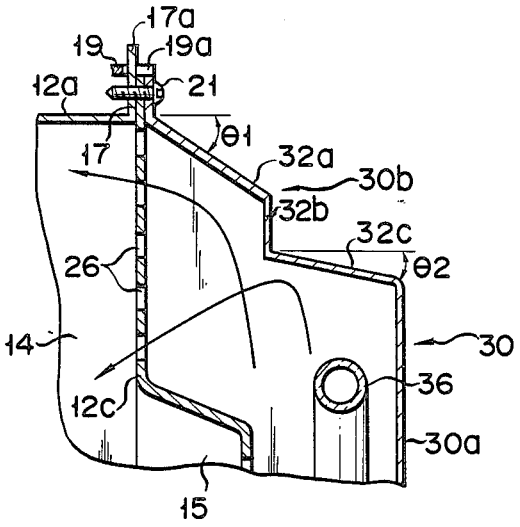

As well appreciated from FIGS. 1, 3 and 4, cover 30 has bottom plate 30*a* facing rear plate 12*c*, upper and lower plates 30*b* and 30*c* slantly extending across the whole width of heating chamber 14, and a pair of vertically extending side plates 30*d*, 30*d*. Upper and lower plates 30*b* and 30*c* are located opposite to upper and lower discharge holes 26 and 28, respectively. Upper plate 30*b* has first air-directing section 32*a* located on the side of top plate 12*a*, vertically extending shoulder 32*b* and second air-directing section 32*c* extending from shoulder 32*b* t bottom plate 30*a*. First air-directing section 32*a* is inclined at angle (an acute angle) $\theta 1$ with respect to top plate 12*a*, i.e., a horizontal plane, and second air-directing section 32*c* is inclined at an angle equal to, or smaller than, the angle $\theta 1$ of first air-directing section 32*a* with respect to a horizontal plane. Similarly, lower plate 30*c* has first air-directing section 33*a*, shoulder 33*b* and second air-directing section 33*c*.

In storing chamber 31 are arranged fan 34 facing suction holes 24 and substantially ring-like electric heater 36 located around the outer periphery of fan 34. Fan 34 is rotated in a predetermined direction i.e., in a counterclockwise direction, by means of motor 38 which is provided outwardly of cover 30.

Figure 5:
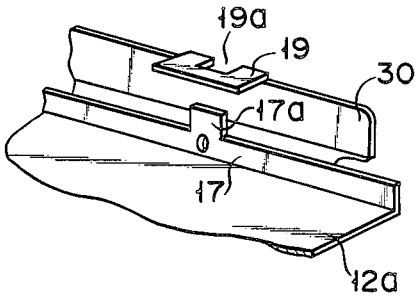

As well appreciated from FIGS. 4 and 5, top plate 12*a* of casing 12 is bent upward at the rear end portion to form bent section 17. The middle portion of bent section 17 further projects upward, thereby forming an engaging piece 17*a*. Latching member 19 with engaging hole 19*a* extends from the upper end of cover 30 in a direction of casing 12. Cover 30 is securely fixed by screw 21 to casing 12 with engaging piece 17*a* inserted into engaging hole 19*a*. In the attachment of cover 30 to casing 12, cover 30 can readily be positioned relative to casing 12 by means of a combination of engaging piece 17*a* and latching member 19.

In FIG. 1, reference numeral 46 represents a motor. Rotation shaft 46*a* of motor 46 extends into heating chamber 14 through bottom plate 12*b* of casing 12. With cooking trays 22*a* and 22*b* not in use, a turntable (not shown) is placed in engagement with rotation shaft 46*a* within heating chamber 14 such that it may be rotated by motor 46.

The cooking oven is equipped with a magnetron (not shown) and can be used as a microwave oven.

The operation of the cooking oven having the above construction will now be described.

When many food items are to be cooked at a time, upper and lower cooking trays 22*a* and 22*b* are set within heating chamber 14 through access opening 16 and, upon closing door 18, motor 38 and heater 36 are operated by actuating the operation section, not shown. When fan 34 is rotated by motor 38, air between cooking trays 22*a* and 22*b* within heating chamber 14 is sucked from suction holes 24 into storing chamber 32. The sucked air, while being agitated in a vortex by the rotation of fan 34, is blown outwardly, at which time it is heated by heater 36 and becomes hot air.

The hot air abuts plates 30*a* and 30*b* of cover 30 and is directed toward rear plate 12*c* of inner casing 12, thereby being discharged into heating chamber 14 through discharge holes 26 and 28. Here, first and second air-directing sections 32*a* and 32*c* of upper plate 30*a* are inclined at different angles and hence the hot air abutting the upper plate is divided into two streams: a stream along the first air-directing section and stream along the second air-directing section. The hot air abutting first air-directing section 32*a* is discharged in a direction substantially parallel to top plate 12*a* of casing 12 from discharge hole 26 and flows to that zone in the neighborhood of door 18. The hot air abutting second air-directing section 32*c* is discharged in a direction different from that of the hot air hit against first air-directing section 32*a*, i.e., into a zone in the neighborhood of discharge holes 26 within heating chamber 14. On the side of lower plate 30*c*, the hot air hitting against first-directing section 33*a* is discharged toward a zone in the neighborhood of door 18 within heating chamber 14, and the hot air hitting against second air-directing section 33*c* is discharged toward a zone in the neighborhood of discharge hole 28. The food items placed on the tray within heating chamber 14 are cooked by the hot air discharged.

According to the hot-air circulation cooker, the hot air is uniformly discharged everywhere into the heating chamber from the discharge holes. On the cooking tray, the food item near the door and food item near the discharge holes can be substantially uniformly heated in a better balance within the heating chamber. Therefore, there is no possibility that some of food items will be over heated within the heating chamber. It is, therefore, possible to prevent the food items displaced on the front and the back of tray from being unevenly browned. The uneven browning of the food items on the upper tray is markedly improved due to the hot air from the upper discharge holes directly hitting the food items on the upper tray. Similarly, the food items which are placed one behind another on the lower tray are uniformly heated through the cooking tray and browned in better condition.

The suction holes are formed in the bottom wall of recess 15 which projects outwardly from the casing, and adequately spaced from the discharge holes. Therefore, the hot air discharged into the heating chamber through the discharge holes always flows through the suction holes into the fan chamber after it has been circulated within the heating chamber, without flowing directly toward the discharge holes. Thus, all the air discharged from the discharge holes can be effectively utilized to heat the food in the heating chamber and discharged into the whole heating chamber so that the food in the heating chamber can be uniformly heated. Furthermore, a larger area is available for food within the heating chamber due to the presence of the recess. Thus, more items of food can be cooked at one time since it is possible to place cooking trays of larger size within the heating chamber.

This invention is not limited to the aforementioned embodiments and various changes and modifications can be made within the invention without departing from the spirit and scope of this invention.

Figure 6:
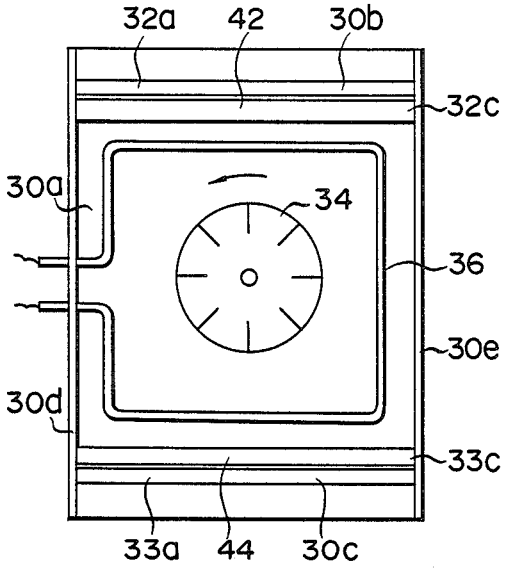
Figure 7:
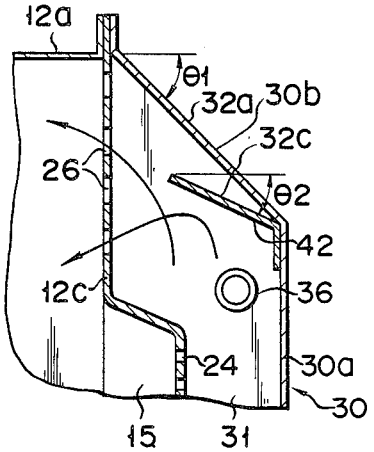

In the first embodiment, for example, the second air-directing section is formed of the upper plate or the lower plate of the cover. However, as shown in FIGS. 6 and 7, the second air-directing section may be formed by an air-directing plate separate from the cover. In this embodiment, upper and lower plates 30*b* and 30*c* of cover 30 constitute first air-directing sections 32*a* and 33*a*, respectively. Second air-directing section 32*c* is formed of air-directing plate 42 which is fixed to bottom plate 30 along the edge of first air-directing section 32*a*. Air-directing plate 42 extends across the whole width of cover 30 and is inclined at an angle of $\theta 2$ ($\theta 2 \leqq \theta 1$) to the horizontal. Similarly, second air-directing section 33*c* is formed of air-directing plate 44 which is fixed to bottom plate 30*a* of cover 30 along the edge of first air-directing section 33*a*. Air-directing plate 44 extends across the whole width of cover 30 and is inclined at an angle, smaller than the inclination angle of first air-directing section 33*a*, with respect to the horizontal.

With the second embodiment it is also possible to prevent the food on the tray within the heating chamber from being unevenly browned as in the first embodiment.

Figure 8:
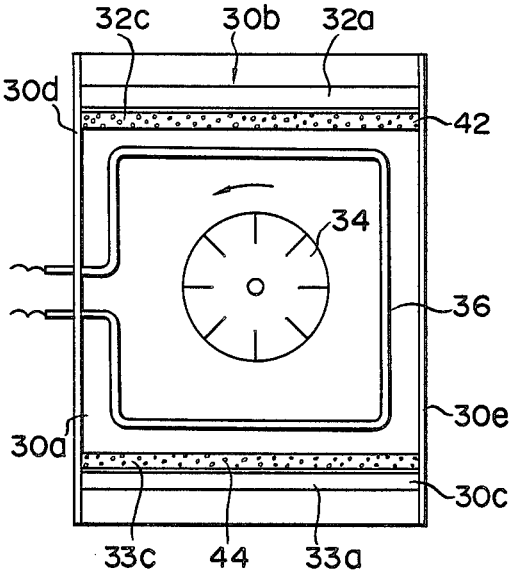
Figure 9:
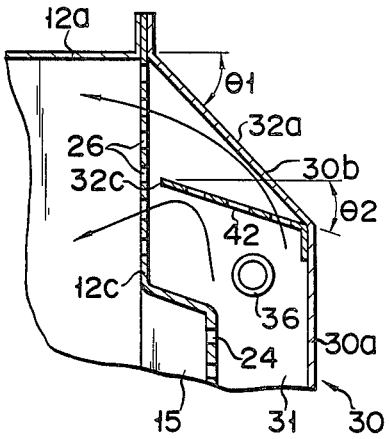

In the second embodiment, air-directing plates 42 and 44 may have a plurality of punched holes as shown in FIGS. 8 and 9. In this case, it is possible to improve uneven heating in the front and rear zones around the cooking tray as in the case of the first embodiment.

Further, any possible imbalance in the amounts of hot air discharged into the left and right zones around the cooking tray within the heating chamber can be improved by the straightening effect of the punched holes. The left-right unbalance, though depending upon the capability of the heater, diameter of the fan, number of rotations of the fan, and so on, can be much improved by selecting the length of the air-directing plate, diameter and pitch of the punched holes, etc.

The number of second air-directing sections can be increased as required. An increased number of the second air-directing sections allows the hot air discharge directions to be finely controlled. Also, the cover defining the storing chamber, may be fixed to any side plate of the inner casing.

What is claimed is:

1. A hot air circulating cooker comprising:

a box-like casing having top and bottom plates and a plurality of side plates which define a heating chamber, one of said side plates of said casing including a plurality of horizontally extending suction holes arranged between a plurality of horizontally extending upper and lower discharge holes;

a cover fixed to the outer surface of said one side plate, said cover and said one side plate defining a storage chamber which communicates with said suction holes and said upper and lower discharge holes, said cover further including:

a pair of a first air directing means located opposite said upper and lower discharge holes, respectively, and inclined at a first predetermined angle for directing part of said hot air in a direction substantially parallel to said top plate, and a pair of second air directing means located opposite said upper and lower discharge holes, respectively, and inclined at a second predetermined angle different from said first predetermined angle for directing part of said hot air in a direction different than the hot air directed by said first air directing means;

a rotatable fan arranged in said storing chamber and facing said suction holes for drawing air from said heating chamber into said storing chamber through said suction holes and discharging said air toward said first and second air directing means so that it passes into said heating chamber through said discharge holes;

a heater arranged in said storing chamber and extending along a periphery of said fan for heating said air drawn into said storing chamber to obtain said hot air; and drive means for rotating said fan.

2. A cooking oven according to claim 1, wherein said second air directing means are inclined at an angle relative to said top plate so that said hot air from said fan is directed to an area within said heating chamber which is in a neighborhood of said discharge holes and further including upper and lower cooking trays arranged in said heating chamber, parallel to said top plate of said casing and spaced from each other, so that said suction holes are located in the space between said cooking trays, said upper discharge holes are located in the space between said top plate and said upper cooking tray and said lower discharge holes are located in the space between said bottom plate and said lower cooking tray.

3. A cooking oven according to claim 2, wherein said one side plate of said casing includes a recess projecting outward and located in the space between said upper and lower cooking trays, and wherein said suction holes are formed in the bottom of said recess.

4. A cooking oven according to claim 1, wherein said cover includes:

a bottom substantially parallel to said one side plate of said casing;

an upper plate and a lower plate inclined toward said upper and lower discharge holes, respectively, which constitutes said first air directing means; and an upper air directing plate and a lower air directing plate extending from said bottom toward said discharge holes which constitute said second air directing means.

5. A cooking oven according to claim 4, wherein said upper and lower air directing plates have a plurality of small holes for further guiding said hot air which is discharged from said fan.

6. A cooking oven according to claim 5, further including upper and lower cooking trays arranged in said heating chamber substantially parallel to said top plate of said casing and spaced from each other so that said suction holes are located between said cooking trays, said upper discharge holes are located between said top plate and said upper cooking tray and said lower discharge holes are located between said bottom plate and said lower cooking tray.

* * * * *